US012623125B2

(12) United States Patent
Gonzalez et al.

(10) Patent No.: US 12,623,125 B2
(45) Date of Patent: May 12, 2026

(54) GOLF CLUB HEAD WITH VARIABLE THICKNESS FACE

(71) Applicant: Acushnet Company, Fairhaven, MA (US)

(72) Inventors: Oswaldo Gonzalez, Corona, CA (US); Kyle A. Carr, Carlsbad, CA (US); Gentry Ferguson, San Marcos, CA (US); Grant M. Martens, San Diego, CA (US); Charles E. Golden, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 214 days.

(21) Appl. No.: 18/428,288

(22) Filed: Jan. 31, 2024

(65) Prior Publication Data

US 2025/0135301 A1 May 1, 2025

Related U.S. Application Data

(63) Continuation-in-part of application No. 18/499,735, filed on Nov. 1, 2023.

(51) Int. Cl.
*A63B 53/04* (2015.01)

(52) U.S. Cl.
CPC ..... *A63B 53/047* (2013.01); *A63B 53/0408* (2020.08); *A63B 53/0462* (2020.08)

(58) Field of Classification Search
CPC ..... A63B 53/047; A63B 53/0458; A63B 53/0462; A63B 53/0454
See application file for complete search history.

(56) References Cited

U.S. PATENT DOCUMENTS

| | | | | |
|---|---|---|---|---|
| 6,368,234 | B1 | 4/2002 | Galloway | |
| 6,746,343 | B2 | 6/2004 | Yoneyama | |
| 10,258,843 | B2 | 4/2019 | Morales | |
| 2003/0176232 | A1 | 9/2003 | Hasebe | |
| 2007/0066420 | A1* | 3/2007 | Imamoto | A63B 53/0466 473/332 |
| 2007/0225086 | A1 | 9/2007 | Lin | |
| 2008/0287216 | A1 | 11/2008 | Nakamura | |
| 2013/0344990 | A1* | 12/2013 | Slaughter | A63B 53/04 473/349 |

FOREIGN PATENT DOCUMENTS

JP H10286333 A 10/1998

OTHER PUBLICATIONS

International Search Report dated Feb. 24, 2025 for European Application No. 24 209 807.7 in 11 pages.

* cited by examiner

*Primary Examiner* — Raeann Gorden
(74) *Attorney, Agent, or Firm* — Randy K. Chang

(57) ABSTRACT

A golf club head with improved striking face is disclosed. More specifically, the present invention relates to a golf club head wherein the striking face portion has two regions of increased thickness to improve the performance of the golf club head. The two regions of increased thickness may be connected via a connecting member to form an obround shaped thickened region.

1 Claim, 6 Drawing Sheets

GOLF CLUB HEAD WITH VARIABLE THICKNESS FACE

CROSS-REFERENCE TO RELATED APPLICATIONS

This application is a Continuation-In-Part (CIP) of U.S. patent application Ser. No. 18/499,735, filed on Nov. 1, 2023, the disclosure of which is incorporated by reference in its entirety.

FIELD OF THE INVENTION

The present invention relates generally to an iron type golf club head having a striking face portion that has variable thickness. More specifically, the present invention relates to an iron type golf club head wherein the striking face portion has two regions of increased thickness, wherein a first region of increased thickness is located near a geometric center of said striking face portion and a second region of increased thickness is located away from said geometric center of the striking face portion. The two regions of increased thickness may be connected via a connecting member to form an obround shaped thickened region.

BACKGROUND OF THE INVENTION

The design of golf club heads often require the proper balance of the desire to maximize the performance of a golf club head together with the durability needs of a golf club head.

One of the areas where these diverging and counter acting forces manifest itself is in the design of the striking face of a golf club head. If a golf club designer wishes to maximize the coefficient of restitution of a golf club head, it would be easy for him or her to reduce the thickness of the striking face of that golf club head, leading to more flexibility of the striking face upon impact with a golf ball leading to further distance gains. However, as indicated earlier, the durability of a striking face that is too thin can often result in mechanical failures such as plastic deformation of the striking face, which is undesirable.

In order to address this issue, golf club designers have invented striking faces with variable thickness wherein the regions experiencing high stresses are thickened while the remainder of the striking face can have a reduced thickness to maximize performance. U.S. Pat. No. 6,368,234 to Galloway illustrates this concept by incorporating concentric elliptical regions of varying thickness into a striking plate of a metalwood type golf club head, located around a geometric center of the striking face where the golf ball is intended to impact the golf club.

Although maximizing distance is one of the main goals of designing for a metalwood type golf club head as illustrated in U.S. Pat. No. 6,368,234 to Galloway, the design of striking faces of iron type golf club heads can be more complicated because maximizing distance is not the main objective. Although distance in iron type golf club head is important, the main objective in designing an iron type golf club head is consistency of performance. Additionally, the challenge in designing an improved face design for an iron type golf club head resides in the shape and dimension of an iron type golf club head that creates a location of max deflection that is different from the general impact location of a golf club head. This separation of these two high stress points makes designing an improved striking face more difficult.

U.S. Pat. No. 6,746,343 to Yoneyama illustrates the utilization of a thick-walled portion in the back of the lower central part of the front face plate and multiple narrow ribs to radially extend from the thick-walled portion towards the upper and lateral peripheral parts of the front face plate as one way to incorporate a variable face thickness profile in an iron type golf club head.

U.S. Pat. No. 10,258,843 to Morales et al. illustrates one of the ways that a variable face thickness profile has in incorporated into an iron type golf club head wherein the striking face is supported by a looped rib to create a variable thickness profile.

These designs, although each having their own performance benefits, fails to take advantage of the unique shape of an iron type golf club head that has an impact location that is different from the geometric center of the striking face.

Hence it can be seen that there is a need in the industry for a new and improved design for the striking face portion of an iron type golf club head that takes advantage of the unique shape of an iron type golf club head and the existence of two locations of high stress that is unique and distinct from one another.

BRIEF SUMMARY OF THE INVENTION

In some aspects, the techniques described herein relate to an iron type golf club head including: a striking face portion located at a frontal portion of said iron type golf club head, adapted to strike a golf ball; wherein said striking face portion has an external frontal surface that is substantially planar, wherein said striking face portion has an internal rear surface that is uneven, wherein said external frontal surface and said internal rear surface combine to define a thickness of said striking face portion, wherein said striking face portion further includes; a first region of increased thickness, located near a centroid of said striking face portion, and a second region of increased thickness, located away from said centroid of said striking face portion, a body portion attached to the rear of said iron type golf club head.

In some aspects, the techniques described herein relate to an iron type golf club head including: a striking face portion located at a frontal portion of said iron type golf club head, adapted to strike a golf ball; wherein said striking face portion has an external frontal surface that is substantially planar, wherein said striking face portion has an internal rear surface that is uneven, wherein said external frontal surface and said internal rear surface combine to define a thickness of said striking face portion, wherein said striking face portion further includes; a second region of increased thickness, located at a location that is 15 mm upwards from a ground plane, and at a distance that is a midpoint of a full length scoreline, a first region of increased thickness, located toeward of said second region of increased thickness, a body portion attached to the rear of said iron type golf club head.

In some aspects, the techniques described herein relate to an iron type golf club head including: a striking face portion located at a frontal portion of said iron type golf club head, adapted to strike a golf ball; wherein said striking face portion has an external frontal surface that is substantially planar, wherein said striking face portion has an internal rear surface that is uneven, wherein said external frontal surface and said internal rear surface combine to define a thickness of said striking face portion, wherein said striking face portion further includes; a second region of increased thickness, located at a location that is 15 mm upwards from a ground plane, and at a distance that is a midpoint of a full length scoreline, a first region of increased thickness, located near a centroid of said striking face portion a body portion attached to the rear of said iron type golf club head, and wherein a first thickness of said first region of increased thickness is thicker than a second thickness said second region of increased thickness.

In some aspects, the techniques described herein relate to an iron type golf club head including: a striking face portion located at a frontal portion of said iron type golf club head, adapted to strike a golf ball; wherein said striking face portion has an external frontal surface that is substantially planar, wherein said striking face portion has an internal rear surface that is uneven, wherein said external frontal surface and said internal rear surface combine to define a thickness of said striking face portion, a first region of increased thickness, located near a centroid of said striking face portion, and a second region of increased thickness, located away from said centroid of said striking face portion, and wherein said first region of increased and said second region of increased thickness are connected to one another via a connecting member of increased thickness, a body portion attached to a rear of said iron type golf club head.

In some aspects, the techniques described herein relate to an iron type golf club head including: a striking face portion located at a frontal portion of said iron type golf club head, adapted to strike a golf ball; wherein said striking face portion has an external frontal surface that is substantially planar, wherein said striking face portion has an internal rear surface that is uneven, wherein said external frontal surface and said internal rear surface combine to define a thickness of said striking face portion, and wherein said striking face portion further includes; a second region of increased thickness, located at a location that is 15 mm upwards from a ground plane, and at a distance that is a midpoint of a full length scoreline, a first region of increased thickness, located toeward of said second region of increased thickness, and wherein said first region of increased and said second region of increased thickness are connected to one another via a connecting member of increased thickness a body portion attached to a rear of said iron type golf club head.

In some aspects, the techniques described herein relate to an iron type golf club head including: a striking face portion located at a frontal portion of said iron type golf club head, adapted to strike a golf ball; wherein said striking face portion has an external frontal surface that is substantially planar, wherein said striking face portion has an internal rear surface that is uneven, wherein said external frontal surface and said internal rear surface combine to define a thickness of said striking face portion, and wherein said striking face portion further includes; a thickened region having an obround shape, wherein a first end of said thickened region is located near a centroid of said striking face portion, and wherein a second end of said thickened region is located at a location that is 15 mm upward from a ground plane, and at a distance that is a midpoint of a full length scoreline. a body portion attached to a rear of said iron type golf club head.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below, and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
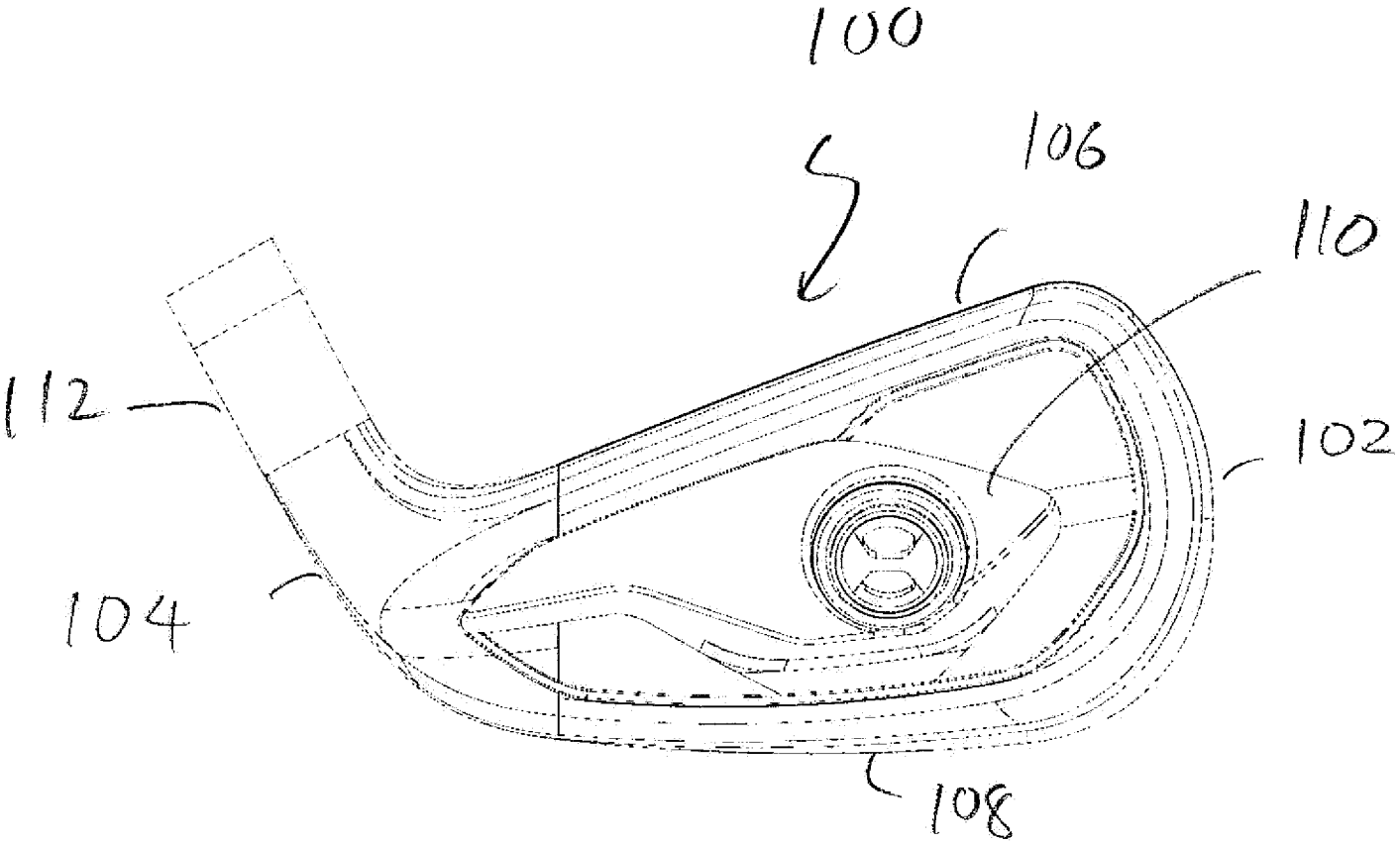
FIG. 1 of the accompanying drawings shows a rear view of a golf club head in accordance with an exemplary embodiment of the present invention.

FIG. 1 of the accompanying drawings shows a rear view of an iron type golf club head 100 in accordance with an exemplary embodiment of the present invention. The iron type golf club head 100 shown here in FIG. 1 may have a toe portion 102, a heel portion 104, a topline 106, a sole 108 and a rear portion 110. The rear portion 110 shown here in this view may incorporate a medallion to cover up the interior cavity of the golf club head 100 without departing from the scope and content of the present invention. Finally, the golf club head 100 shown here may have a hosel 112 attached to the upper heel portion 104 of the golf club head 100.

Figure 2:
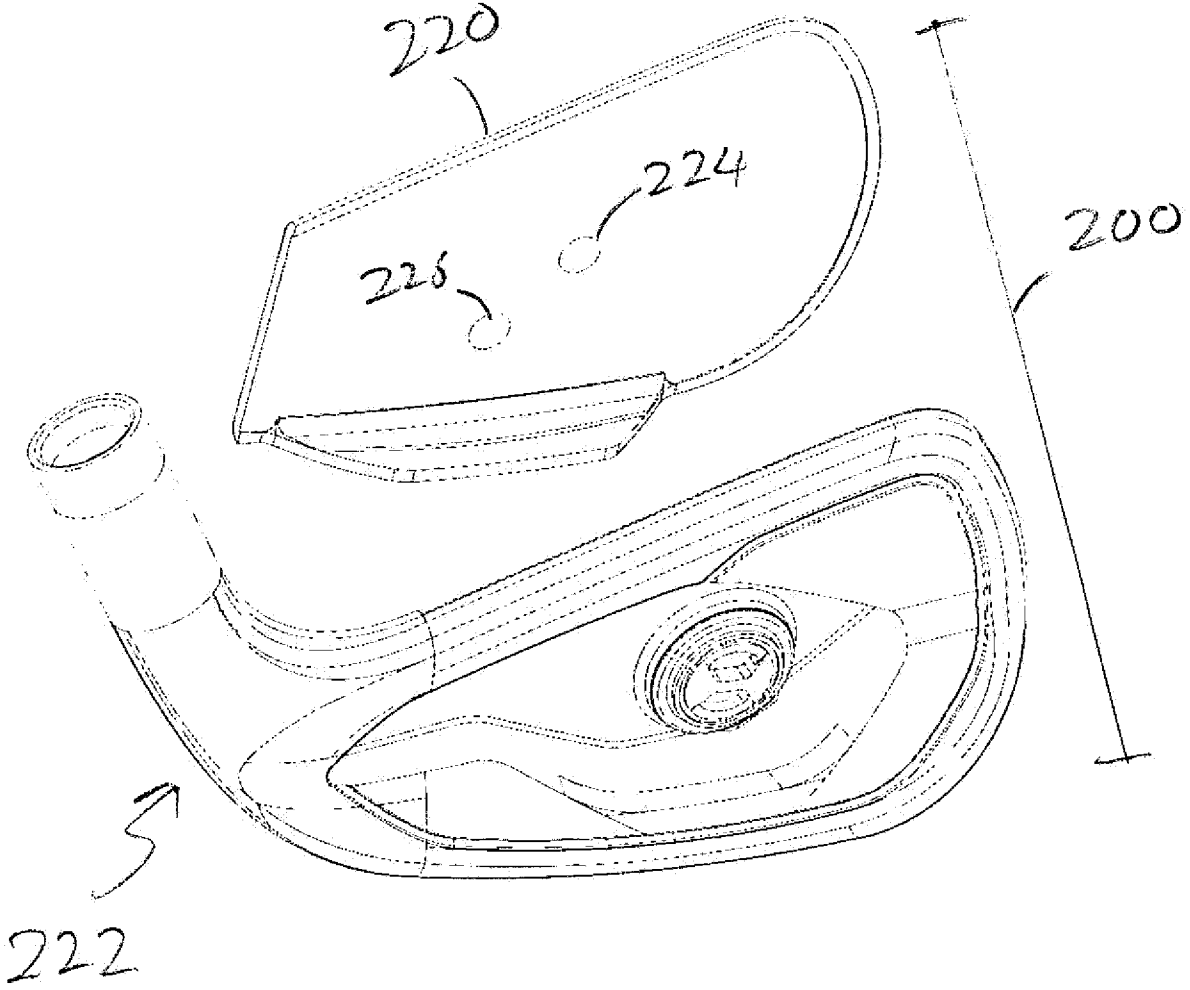
FIG. 2 of the accompanying drawings shows an exploded rear view of a golf club head in accordance with an exemplary embodiment of the present.

FIG. 2 of the accompanying drawings shows an exploded rear view of a golf club head 200 in accordance with an exemplary embodiment of the present invention allowing the striking face portion 220 to be show more clearly. In this exploded perspective view of the golf club head 200 show in FIG. 2, we can see that the golf club head 200 is separated into the striking face portion 220 and a body portion 222. The striking face portion 220 is adapted to strike a golf ball, and the rear body portion 222 is attached to a rear of the iron type golf club head 200. Additionally, this exploded view allows that improved variable thickness geometry of the striking face portion 220 having a first region of increased thickness 224 and a second region of increased thickness 226 to be shown.

In this exemplary embodiment of the present invention, the first region of increased thickness 224 is a circular in shape to provide more structural integrity to that location on the striking face portion 220 and for simplicity of manufacturing. However, it should be noted that in alternate embodiment of the present invention, the shape of the first region of increased thickness 224 could be an oval, rectangular, square, or even any other geometric shape without departing from the scope and content of the present invention, so long as it is capable of providing a region of increased thickness that improves structural integrity. The second region of increased thickness 226 shown here is also circular in shape, but similar to the previous discussion, this second region of increased thickness 226 could take on alternate shapes also without departing from the scope and content of the present invention. It should be noted that in this exemplary embodiment of the present invention, bot the first region of increased thickness 224 and the second region of increased thickness 226 may both have the same circular shape with the same diameter, however, in alternative embodiments of the present invention, the first region of increased thickness 224 and the second region of increased thickness 226 may be in different shapes without departing from the scope and content of the present invention. In fact, even in embodiments wherein the first region of increased thickness 224 and the second region of increased thickness 226 are both circular in shape, their diameters could be different from one another without departing from the scope and content of the present invention.

Figure 3:
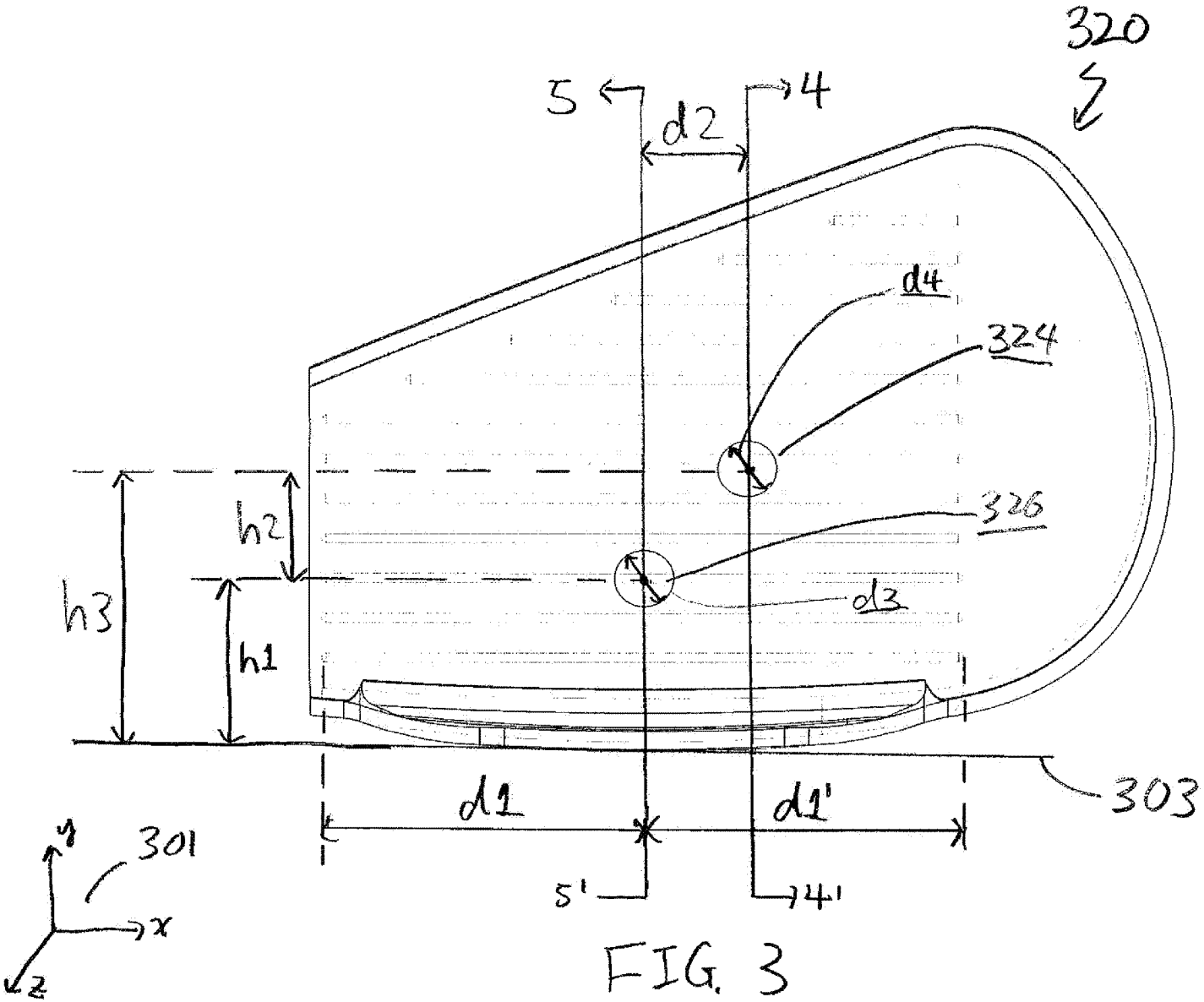
FIG. 3 of the accompanying drawings shows a rear view of the striking face portion in accordance with an exemplary embodiment of the present invention.

FIG. 3 of the accompanying drawings shows a rear view of the striking face portion 320 in accordance with an exemplary embodiment of the present invention. More specifically, this enlarged rear view of the striking face portion 320 allows the location of the first region of increased thickness 324 and the second region of increased thickness 326 to be shown and properly dimensioned, and illustrates that the second region of increased thickness 326 is located away from the first region of increased thickness 324.

The second region of increased thickness 326 is located heelward of the first region of increased thickness 324 and is located at the midpoint of the full length scorelines at the bottom of the striking face portion 320, along the x-axis as referenced in the coordinate system 301. More specifically, it can be said the location of the center of the circle of the second region of increased thickness 326 is located along the x-axis such that the distance d1 to the heel terminus of the full length scoreline and the distance d1' to the toe terminus of the full length scoreline is the same. The overall distance of the full length scoreline is about 54 mm, which means the heel side distance d1 is about 27 mm, and the toe side distance d1' is about 27 mm. The height h1 of the center of the circle that represents the second region of increased thickness 326 shown here in FIG. 3 may generally be about 15 mm above the ground plane 303 along the y-axis shown in coordinate system 301.

Once the location of the second region of increased thickness 326 has been defined, the size and shape of this second region of increased thickness 326 can be explained. In this embodiment of the present invention, as it can be seen in FIG. 3 of the accompanying drawings, the second region of increased thickness 326 is circular in shape, with a diameter d3 of between about 5 mm to about 10 mm, more preferably between about 6 mm to about 9 mm, and most preferably between about 7 mm to about 8 mm.

The location of the first region of increased thickness 324, in accordance with this exemplary embodiment of the present invention may be located toeward of the second region of increased thickness 326. More specifically, the location of the first region of increased thickness 324 is located at a distance d2 toweward of the second region of increased thickness 326 of between about 8.0 mm to about 9.0 mm, more preferably of between about 8.25 mm to about 8.75 mm, and most preferably of about 8.75 mm, along the x-axis illustrated by the coordinate system 301. Inversely, it can be said that the second region of increased thickness 326 may at the same distances heelward of the first region of increased thickness 324 without departing from the scope and content of the present invention. The height of the first region of increased thickness 324 can be quantified both in terms of its height relative to the second region of increased thickness 324 or to the ground plane 303. The height of the first region of increased thickness 324, as measured to the second region of increased thickness 324 may be quantified by height h2 relative to the second region of increased thickness 326, which is generally be between about 7.0 mm to about 10.0 mm, more preferably between about 8.0 mm to about 9.0 mm, and most preferably about 8.5 mm, measured along the y-axis as illustrated by the coordinate system 301. Alternatively speaking, it can be said that the first region of increased thickness 324 is located higher up on the striking face portion 320 than the second region of increased thickness 326. Inversely, it can also be said that the second region of increased thickness 326 is located lower on the striking face portion 320 than the first region of increased thickness 324. The height of the first region of increased thickness 324 may also be quantified by height h3 relative to the ground plane 303, which is generally between about 22 mm to about 25 mm, more preferably between about 23 mm to about 24 mm, and most preferably about 23.5 mm. Alternatively speaking, it can be said that the second region of increased thickness 326 is located at a distance h3 upward from a ground plane at a distance that is located at a midpoint of a full length scoreline.

Once the location of the first region of increased thickness 324 has been defined, the size and shape of this first region of increased thickness 346 can be explained. In this embodiment of the present invention, as it can be seen in FIG. 3 of the accompanying drawings, the first region of increased thickness 324 is circular in shape, with a diameter d4 of between about 5 mm to about 10 mm, more preferably between about 6 mm to about 9 mm, and most preferably between about 7 mm to about 8 mm.

It should be noted that despite the above discussion regarding the location of the first region of increased thickness 324 being specific dimensions relative to the second region of increased thickness 326 and the ground plane 303 for this exemplary embodiment, the precise location of the first region of increased thickness 324 may be differ because it is technically dependent on the shape of the striking face portion 320 itself. To be technically correct, the location of the first region of increased thickness needs to be located at a centroid of said striking face portion 320. The centroid of any geometric shape can also be defined as the geometric center of any shape, and in this embodiment, relates to a two-dimensional shape of the striking face. The definition and calculation of the centroid location is a mathematical determination that often involved the integral taken over the striking face portion 320 based off the formula $$\text{Centroid} = \frac{\int xg(x)dx}{\int g(x)dx}.$$

Here, in this embodiment shown in FIG. 3, because the striking face portion 320 has a substantially rectangular shape that increases in height towards the toe portion of the striking face portion 320, the centroid, or the first region of increased thickness 324 is located towards the toe and higher on the face when compared to the second region of increased thickness 326.

Based on the definition of the centroid above, it should be appreciated here that the dimensional measurements of the location of the first region of increased thickness 324 may vary depending on the geometry of the striking face portion 320, and such minor variations in dimensional measurements should not depart from the scope and content of the present invention so long as the location of the first region of increased thickness 324 is located on or about the centroid of the striking face portion 320.

It is worth noting here that the locations of both the first region of increased thickness 324 being located at the centroid of the striking face portion 320 and the location of the second region of increased thickness 326 being located at a distance that is in the middle of the full length scorelines and at a distance of 15 mm up from the ground plane 303 are critical to the proper functionality of the present invention, as harmonizes and balances the unique need of iron type golf club heads 100 to achieve consistency in performance across the face as well as minimizes the high stresses that tends to occur based on the geometry of iron type golf club heads 100.

The striking face portion 320 in accordance with this exemplary embodiment of the present invention may generally have a two-dimensional surface area of between about 2,500 $mm^2$ to about 3,000 $mm^2$, more preferably between about 2,600 $mm^2$ to about 2,900 $mm^2$, and most preferably about 2,750 $mm^2$ all without departing from the scope and content of the present invention.

Figure 4:
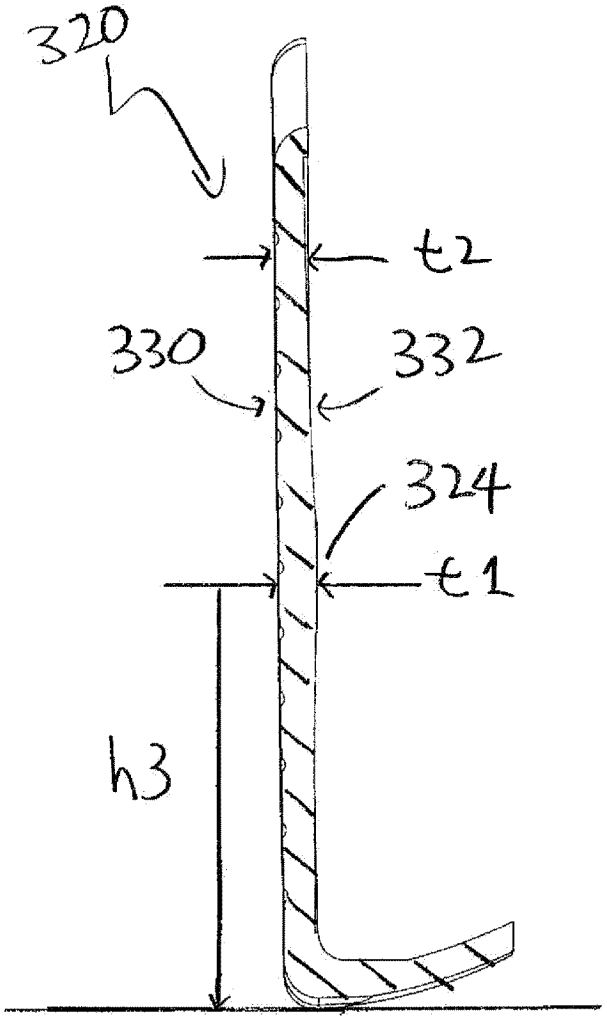
FIG. 4 of the accompanying drawings shows a cross-sectional view of the striking face portion in accordance with an exemplary embodiment of the present invention, taken along cross-sectional line 4-4' shown in FIG. 3.

FIG. 4 of the accompanying drawings shows a cross-sectional view of the striking face portion 320 in accordance with an exemplary embodiment of the present invention, taken along cross-sectional line 4-4' shown in FIG. 3. In this cross-sectional view of the striking face portion 320 shown in FIG. 4, we can better illustrate the shape and thickness of the striking face portion 320 more clearly. The striking face portion 320 in accordance with this embodiment of the present invention may generally have a substantially planar frontal surface 330 and an internal rear surface 332 that is uneven. The combination of this substantially planar frontal surface 330, combined with the uneven internal rear surface 332 allows the formation of the variable thickness profile for the striking face portion 320. The striking face portion 320 shown in this cross-sectional view of FIG. 4 shows that the striking face portion has a first region of increased thickness 324 having a first thickness t1 of between about 2.00 mm to about 2.20 mm, more preferably between about 2.05 mm to about 2.15 mm, and most preferably about 2.10 mm, which is the thickest portion along this cross-sectional line 4-4'. The perimeter of the striking face portion 320 may generally have a reduced thickness t2 of less than about 1.70 mm, more preferably less than about 1.65 mm, and most preferably less than about 1.50 mm, without departing from the scope and content of the present invention.

Figure 5:
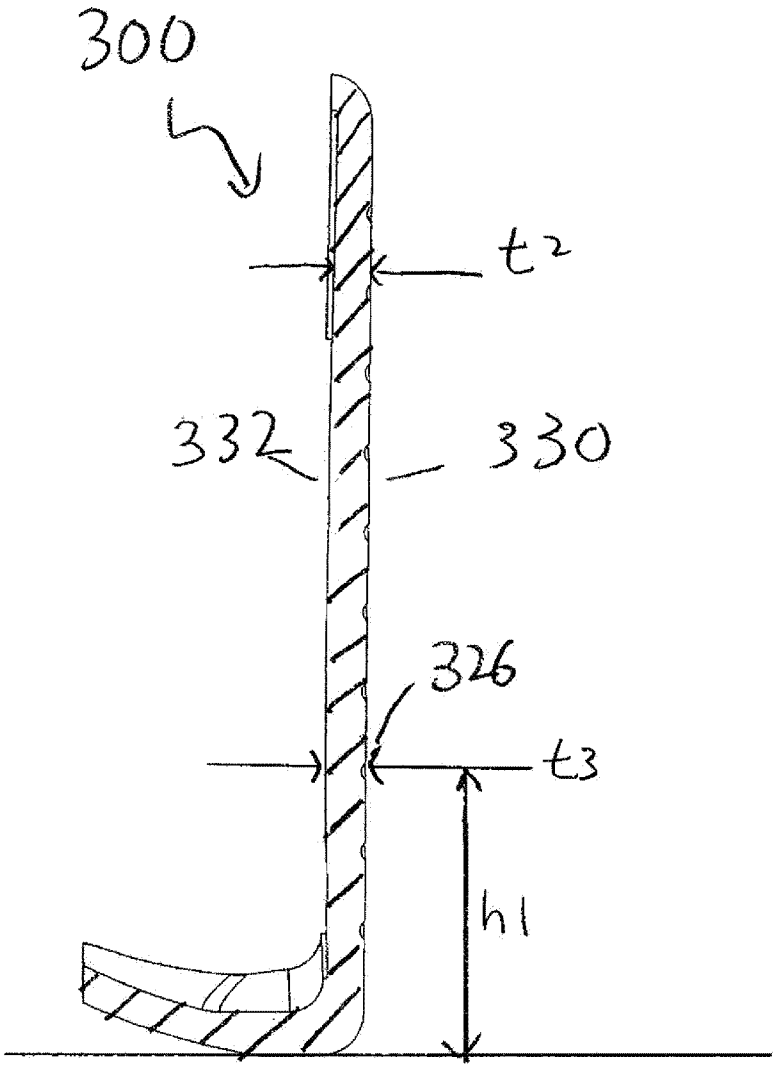
FIG. 5 of the accompanying drawings shows a cross-sectional view of the striking face portion in accordance with an exemplary embodiment of the present invention, taken along cross-sectional line 5-5' shown in FIG. 3.

FIG. 5 of the accompanying drawings shows a cross-sectional view of the striking face portion 320 in accordance with an exemplary embodiment of the present invention, taken along cross-sectional line 5-5' shown in FIG. 3. In this cross-sectional view that passes through the second region of increased thickness 326, the external frontal surface 530 is substantially planar, while the internal rear surface 332 is also uneven, creating the variable thickness profile that is shown in FIG. 5. In this cross-sectional view of the striking face portion 320 shown in FIG. 5, we can see that the second region of increased thickness 326 may generally have a second thickness t3 of between about 1.75 mm to about 1.95 mm, more preferably between about 1.80 mm to about 1.90 mm, and most preferably about 1.85 mm. The perimeter of the striking face portion 320, similar to what is previous described, may generally have a reduced thickness t2 of less than about 1.70 mm, more preferably less than about 1.65 mm, and most preferably less than about 1.50 mm, without departing from the scope and content of the present invention.

Based on the relative thicknesses of the first region of increased thickness 324 and the second region of increased thickness 326 described above, we can see that the first region of increased thickness 326 may generally be thicker than the second region of increased thickness 324. This thickness relationship is critical to the present invention, as that region of the golf striking face portion 320 may generally experience higher stresses due to the fact that the first region of increased thickness is located at the centroid of the striking face portion 320. In fact, this ratio of thickness is so critical, it is important to recognize that the first thickness of the first region of increased thickness 324 that is located at the centroid may generally be more than about 1.10 times greater than the second thickness of the second region of increased thickness 326, more preferably more than about 1.12 time greater than the second thickness of the second region of increased thickness 326, and most preferably more than about 1.13 time greater than the second thickness of said second region of increased thickness 326, all without departing from the scope and content of the present invention.

Figure 6:
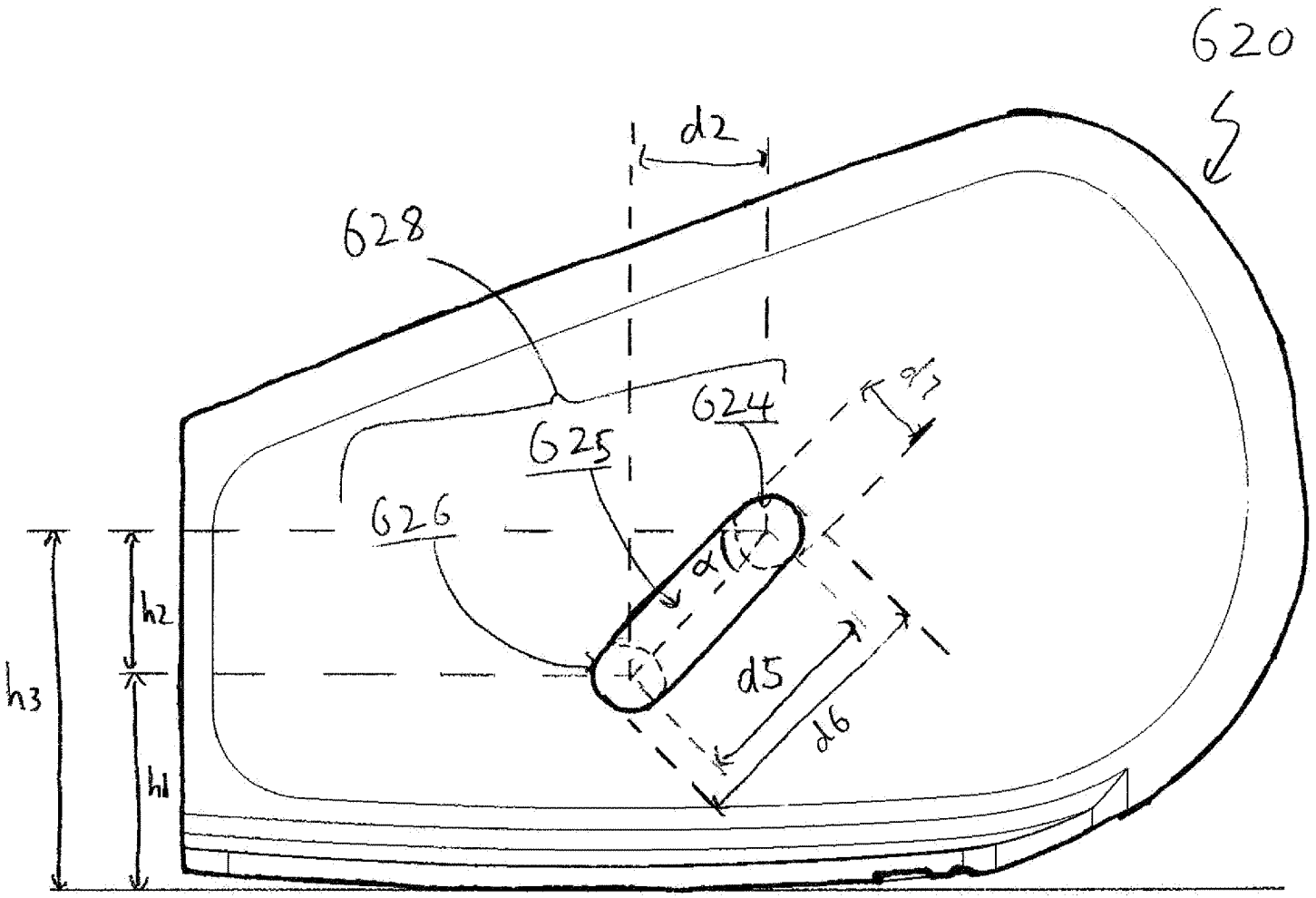
FIG. 6 of the accompanying drawings shows a rear view of the striking face portion in accordance with an alternative embodiment of the present invention.

FIG. 6 of the accompanying drawings shows a rear view of the striking face portion 620 in accordance with an alternative embodiment of the present invention. More specifically, this enlarged rear view of the striking face portion 620 allows the location of the first region of increased thickness 624 and the second region of increased thickness 626 to be shown together with a connecting member 625 that connects the first region of increased thickness 624 to the second region of increased thickness 626, creating an overall thickened region 628 having an obround shape. The location of the terminal ends of the obround shaped thickened region 628 are defined by the first region of increased thickness 624 and the second region of increased thickness 626, which have been described previously. The diameter d3 of the first region of increased thickness 624 and the diameter d4 of the second region of thickness 626 are, once again, similar to the discussion above, resulting in a width of the obround thickened region 628 having a width d7 of between about 5 mm to about 10 mm, more preferably between about 6 mm to about 9 mm, and most preferably between about 7 mm to about 8 mm. In alternative embodiments of the present invention, the width d7 of the obround thickened region 628 may be smaller to reduce the amount of mass associated with this region to be between about 4.0 mm to about 6.0 mm, more preferably between about 4.5 mm to about 5.5 mm, and most preferably about 5.0 mm without departing from the scope and content of the present invention.

In addition to the width of the obround thickened region 628, FIG. 6 of the accompany drawings shows the overall length d6 of the obround thickened region 628 as being between about 16 mm to about 21 mm, more preferably between about 17.5 mm to about 19.5 mm, and most preferably about 18.5 mm. Alternative, because the terminal ends of the obround thickened region 628 are formed out of circular shaped first region of increased thickness 624 and a circular shaped second region of increased thickness 626, the length of the obround thickened region 628 could also be identified as the distance of the center of each circle, which would be quantified by length d5 of between about 11 mm to about 16 mm, most preferably between about 12.5 mm to about 14.5 mm, and most preferably about 13.5 mm. Finally, FIG. 6 of the accompanying drawings also illustrates an angle α that describes the orientation of the obround thickened region 628 being between about 45 degrees to about 50 degrees, more preferably between about 46.5 degrees to about 48.5 degrees, and most preferably about 47.5 degrees.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. An iron type golf club head comprising:

a striking face portion located at a frontal portion of said iron type golf club head, adapted to strike a golf ball;

wherein said striking face portion has an external frontal surface that is substantially planar, wherein said striking face portion has an internal rear surface that is uneven, wherein said external frontal surface and said internal rear surface combine to define a thickness of said striking face portion, and wherein said striking face portion further comprises;

a thickened region having an obround shape, wherein a first end of said thickened region is located near a centroid of said striking face portion, and wherein a second end of said thickened region is located at a location that is 15 mm upward from a ground plane, and at a distance that is a midpoint of a full length scoreline, a body portion attached to a rear of said iron type golf club head, wherein thickened region having said obround shape is angled at an angle α of between about 45 degrees to about 50 degrees, and wherein said thickened region having said obround shape has a width of between about 4.0 mm to about 6.0 mm.

* * * * *